United States Patent [19]

Gibson

[11] Patent Number: 4,940,335

[45] Date of Patent: Jul. 10, 1990

[54] METHOD AND APPARATUS FOR ADDING PREDETERMINED QUANTITY OF MATERIAL TO A REACTOR

[76] Inventor: Adler E. Gibson, P.O. Box 35587, Tulsa, Okla. 74153

[21] Appl. No.: 273,999

[22] Filed: Nov. 21, 1988

[51] Int. Cl.[5] ..... B28C 7/06; B28C 7/16

[52] U.S. Cl. ..... 366/8; 222/166; 366/19; 366/30; 366/46; 366/47

[58] Field of Search ..... 366/8, 16, 19, 45, 46, 366/47, 48, 150, 183, 193, 30, 33, 36, 39, 41, 27, 18, 1, 2, 34; 141/1; 222/160, 164, 166, 608, 561, 559, 556; 298/7, 23.5, 38, 2; 414/381, 287, 293, 303, 154; 73/426, 427, 428, 429

[56] References Cited

U.S. PATENT DOCUMENTS

| | | | |
|---|---|---|---|
| 446,758 | 2/1892 | Lawson | 414/381 X |
| 472,648 | 4/1892 | Wilson | 414/381 X |
| 979,778 | 12/1910 | Malloy | 366/33 X |
| 1,219,737 | 3/1917 | Heilig | 222/561 |
| 1,261,511 | 4/1918 | Goeringer | 366/41 |
| 1,351,361 | 8/1920 | West | 366/18 |
| 1,588,110 | 6/1926 | Hughes | 298/38 |
| 1,743,094 | 1/1930 | Barrett | 298/38 |
| 1,848,959 | 3/1932 | Longenecker | 366/27 |
| 1,986,864 | 1/1935 | Tolley | 222/166 |
| 2,275,331 | 3/1942 | Weckerly | 222/556 X |
| 2,314,647 | 3/1943 | Longenecker | 414/287 |
| 2,591,785 | 4/1952 | Crawford et al. | 366/18 X |
| 2,628,127 | 2/1953 | Palsgrove et al. | 298/19 R |
| 2,703,227 | 3/1955 | Hughes | 366/39 |
| 2,762,529 | 9/1956 | Johnson | 222/164 X |
| 3,693,774 | 9/1972 | Meitl | 193/5 X |
| 4,097,926 | 6/1978 | Face, Jr. | 366/46 |
| 4,157,769 | 6/1979 | Radel | 366/19 X |
| 4,619,531 | 10/1986 | Dunstan | 366/18 X |

FOREIGN PATENT DOCUMENTS

| | | | |
|---|---|---|---|
| 951718 | 7/1974 | Canada | 366/39 |
| 2705589 | 8/1978 | Fed. Rep. of Germany | 366/39 |
| 673203 | 1/1930 | France | 366/39 |
| 1197198 | 11/1959 | France | 366/39 |
| 893305 | 4/1962 | United Kingdom | 366/19 |

*Primary Examiner*—Scott J. Haugland
*Assistant Examiner*—Philip R. Coe
*Attorney, Agent, or Firm*—William S. Dorman

[57] ABSTRACT

A system for adding a predetermined volume of particulate material to a reactor which includes an inclined track mounted on the reactor such that a lower end of the track terminates adjacent an opening in the reactor, and a slideable container mounted on the track for sliding movement from an upper end of the track to the lower end of the track, the container having an internal volume equal to the predetermined volume, and having a forward wall which can be opened to discharge the contents of the container. The container is filled with particulate material, such as sand, when the container is adjacent the upper end of the track. The container is thereafter moved downwardly along the track until the container is adjacent the opening in the reactor, the forward wall of the container is opened to allow particulate material to flow into the opening of the reactor and the container is thereafter tilted towards the reactor to discharge any remaining particulate material in the container into the reactor.

8 Claims, 7 Drawing Sheets

METHOD AND APPARATUS FOR ADDING PREDETERMINED QUANTITY OF MATERIAL TO A REACTOR

BACKGROUND OF THE INVENTION

1. Field of the Invention

The present invention relates to a method and apparatus for adding a predetermined quantity of material to a reactor. More particularly, this invention relates to a method and apparatus for adding a predetermined quantity of sand to a cement or mortar mixer.

2. The Prior Art

It is extremely important to properly ratio the amounts of sand, water, and cement which are mixed in a cement or mortar mixer. That is, for each bag of Portland cement (94 pounds per cubic foot) there should be a predetermined number of gallons or pounds of water and a predetermined number of cubic feet of sand (80 pounds per cubic foot). In response to the demands of the architect, many masonry contractors or plastering contractors have a one cubic foot box made out of plywood which the workers are supposed to use for adding the sand. This plywood box is used by the workers whenever the architect or other inspector is present at the job site. However, when there is no architect and/or inspector present at the job site, some of the workers may take short cuts and approximate the one cubic foot of sand by a predetermined number of shovelfuls of sand. This leads to inaccuracies because it is easy to lose track of the number of shovelfuls. Secondly, the workman might have a tendency to put less sand on the shovel at the end of the day as compared to the morning.

A preliminary search was conducted on the present invention. The following listed U.S. patents were uncovered in the search:

2,628,127
3,160,439
3,323,837
3,578,806
3,693,744
4,494,797
4,619,531
4,632,461

None of the above patents are considered to be sufficiently pertinent as to require any comment.

SUMMARY OF THE INVENTION

A method and apparatus for adding a predetermined volume of particulate material, such as sand, to a reactor, such as a mortar mixer, which comprises mounting an inclined track on the reactor such that a lower end of the track terminates adjacent an opening in the reactor, mounting a slideable container on the track for sliding movement from an upper end of the track to the lower end of the track, the container having an internal volume equal to said predetermined volume, and having a forward wall which can be opened to discharge the contents of the container, filling the container with particulate material when the container is adjacent the upper end of the track, moving the container downwardly along the track until the container is adjacent the opening in the reactor, opening the forward wall of the container to allow particulate material to flow into the opening of the reactor and thereafter tilting the container towards the reactor to discharge any remaining particulate material in the container into the reactor.

DETAILED DESCRIPTION OF THE DRAWINGS

Figure 1:
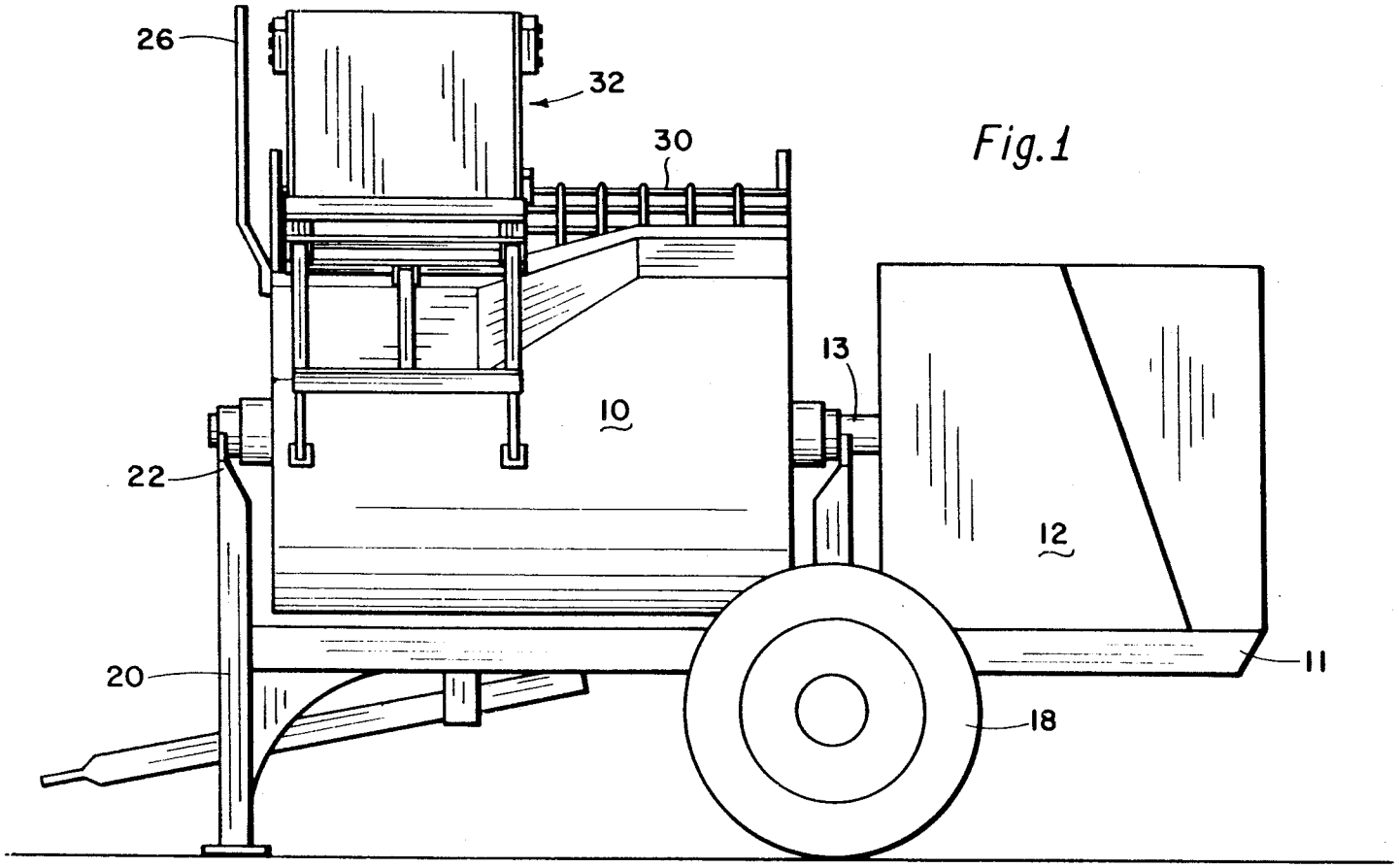
FIG. 1 is a side elevation of a cement or mortar mixer showing the slideable cart or box of the present invention mounted thereon.
Figure 2:
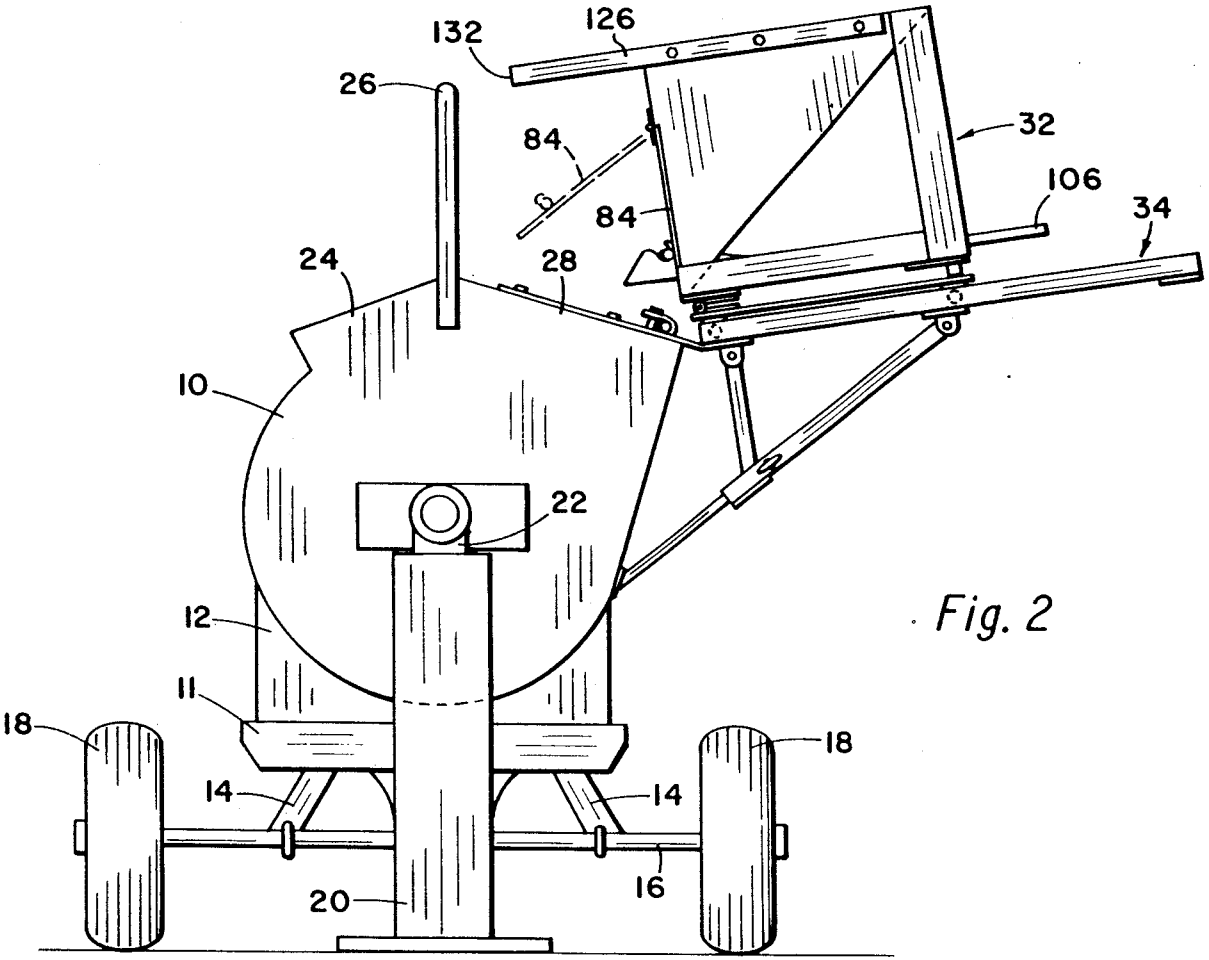
FIG. 2 is a front end view of a cement or mortar mixer showing the slideable cart or box of the present invention mounted thereon and in a position for dumping sand into the mixer.

Referring to the drawings in detail, FIGS. 1 and 2 show a mixer 10 which can be described as a cement mixer or mortar mixer and which may be, for example, of the paddle type. No particular signifance, however, is attached to the type of mixer involved. The mixer is mounted on a bed 11 which also supports a conventional motor 12 for turning the shaft 13 on which the paddles (not shown) of the mixer are mounted. The bed 11 has attached to its underside suitable braces 14 which connect with an axle 16 on the ends of which are a pair of wheels 18. At the forward end of the mixer apparatus is a vertical standard 20 which rests, at its lower end, on the ground and which, at its upper end 22, supports the forward end of the mixer. The standard can be lifted or removed so that the entire apparatus can be moved along on the wheels 18. The mixer housing 24 is provided with a handle 26 at the upper end thereof, such that the housing can be rotated to the position shown in FIG. 3 for dumping and cleaning purposes. The upper end of the mixer is provided with an opening 28 which is covered by a grate 30 to permit the introduction of sand, portland cement, water, etc., into the interior of the mixer.

The elements described up to this point are found on a conventional mixer. There are other conventional elements on a conventional mixer, but these need not be described for the purposes of the present invention.

The present invention includes a slideable box or cart 32 and a track 34 along which the cart is allowed to slide. The track 34, can be removably attached to the mixer, as will hereinafter appear.

Figure 5:
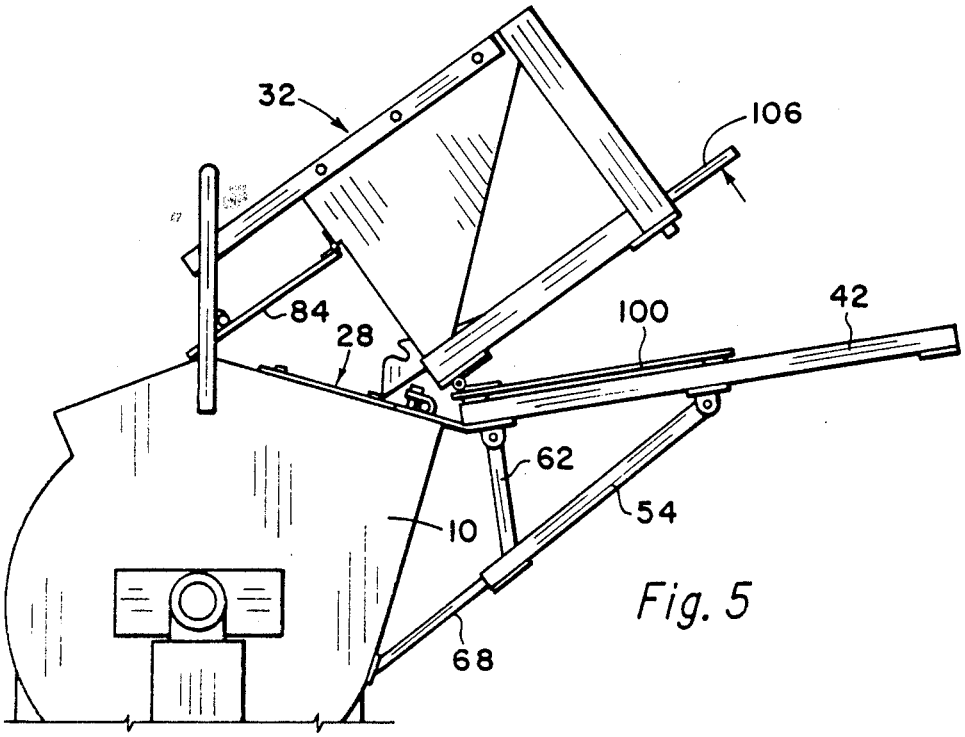
FIG. 5 is a partial front elevation similar to FIG. 2, but showing the cart being rotated to dump sand into the mixer.
Figure 6:
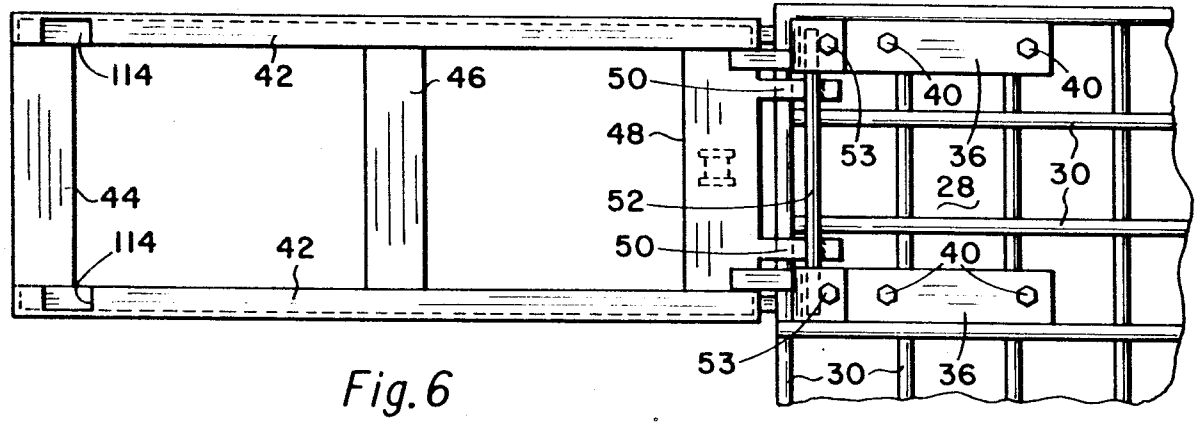
FIG. 6 is a plan view of the track which is attached to the mixer for supporting the cart of the present invention.
Figure 7:
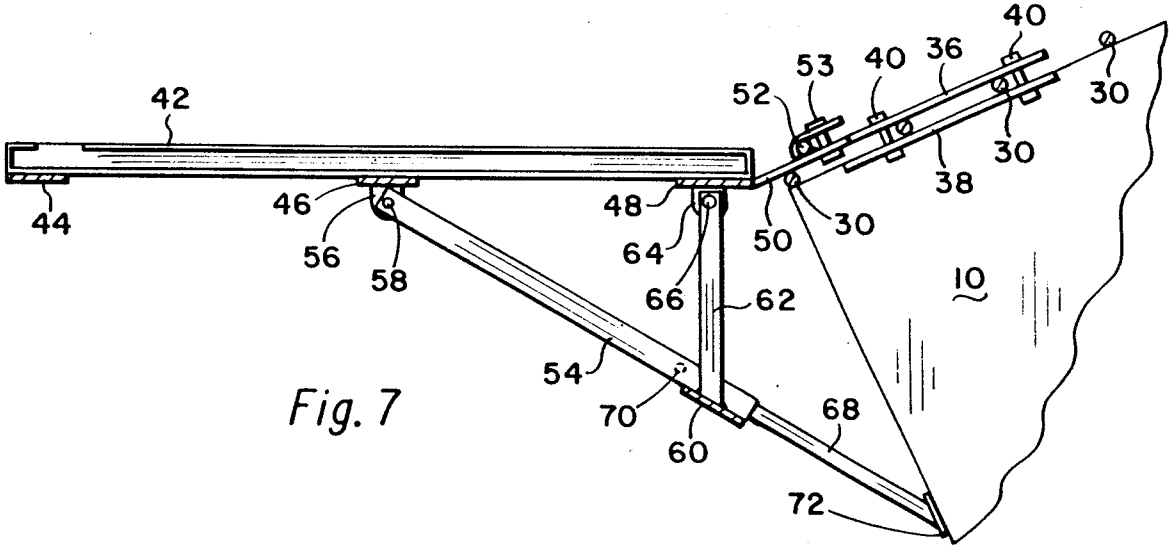
FIG. 7 is a sectional view taken along line 7—7 of FIG. 6.

In order to attach the upper end of the track to the mixer, we will employ a pair of J-shaped plates or straps 36 which are adapted to overlie a portion of the grate 30. Another pair of shorter plates or straps 38 (only one of which is shown in FIG. 7) are disposed below the grate 30 and in alignment with the J-shaped plates 36. Four nut and bolt combinations 40 are passed through the plate 38 and J-shaped members 36 to clamp the J-shaped members to the grate 30 as shown in FIGS. 5 and 6.

The track itself consists of a pair of parallel channels 42 which are connected together by a cross brace 44 at one end, a cross brace 46 at the center, and an angled plate 48 at the end opposite from the cross brace 44. The plate 48 has a pair of forwardly projecting fingers 50 which are disposed at an angle with respect to the remaining portion of the plate 48. The width across the fingers 50 is narrower than the space between the two channels 42 so as to fit into the space between the two J-shaped members 36. A rod 52 is welded to the upper surfaces of the fingers 50 such that the outer ends of the rod 52 can be received in the J portion of the members 36.

Figure 3:
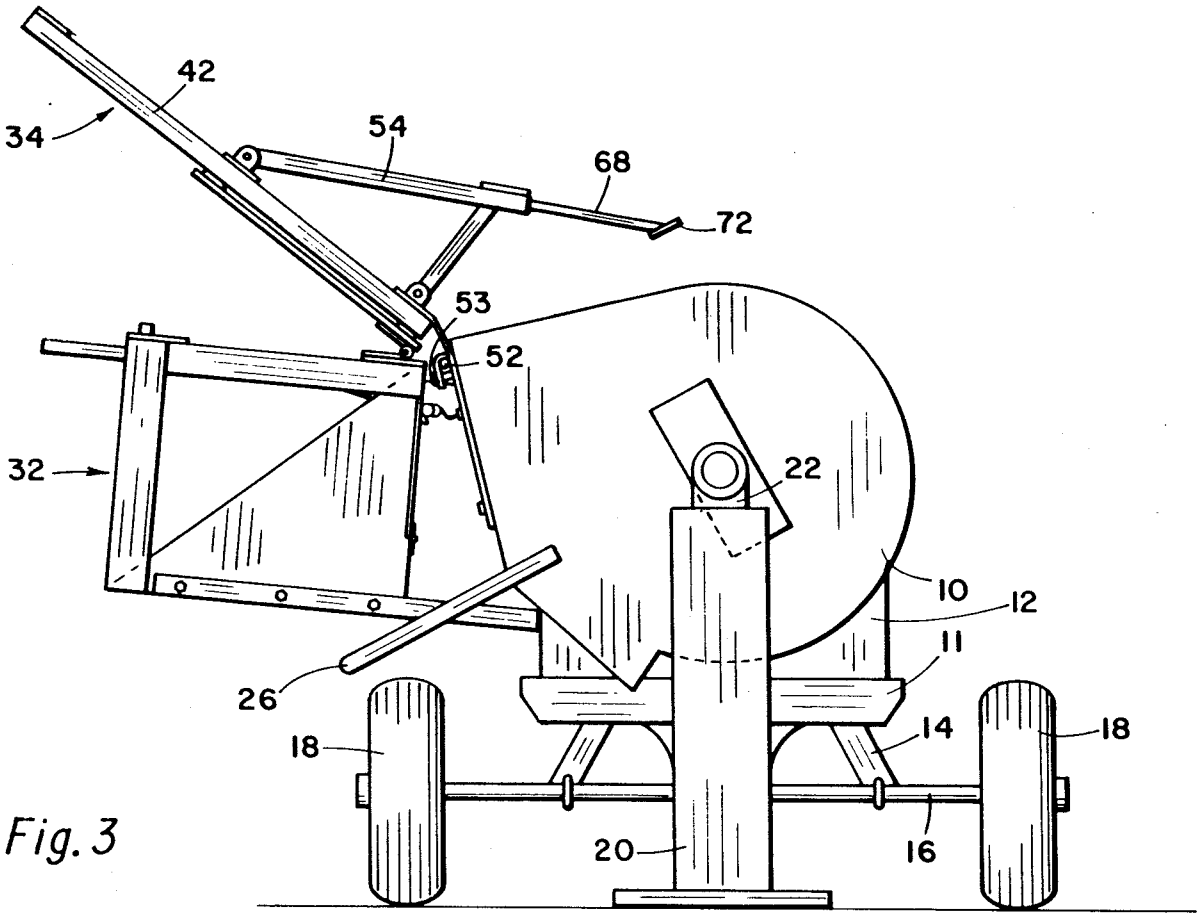
FIG. 3 is a front end view of the same elements shown in FIG. 2, but with the mixer housing and sand box being rotated to a position for dumping or cleaning.

A pair of bolts 53 extend across the J portion to hold the ends of the rod 52 in the mouth of the J portion when the mixer is rotated to the position shown in FIG. 3. A pair of legs 54 (only one of which is shown in FIG. 6) are pivotably connected to the cross brace 46 by means of ears 56 which are welded to the underside of the brace 46 and pins 58 which pass through the ears 56 and upper ends of the legs 54. A brace or cross member 60 extends across the lower end of the legs 54 and a vertical strut 62 extends upwardly from the brace 60 and connects with the plate 48 by means of an ear 64 welded to the plate 48 and a pin 66 which passes through the ear 64 and the upper end of the strut 62. Outrigger extensions 68 are telescopically received within the legs 54 and can be adjusted to a proper extension by means of pins 70 which pass through appropriate holes in the legs 54 and the outrigger 68. The ends of the outrigger 68 are provided with inclined shoes 72 which are adapted to bear against the side of the mixer 10.

Figure 8:
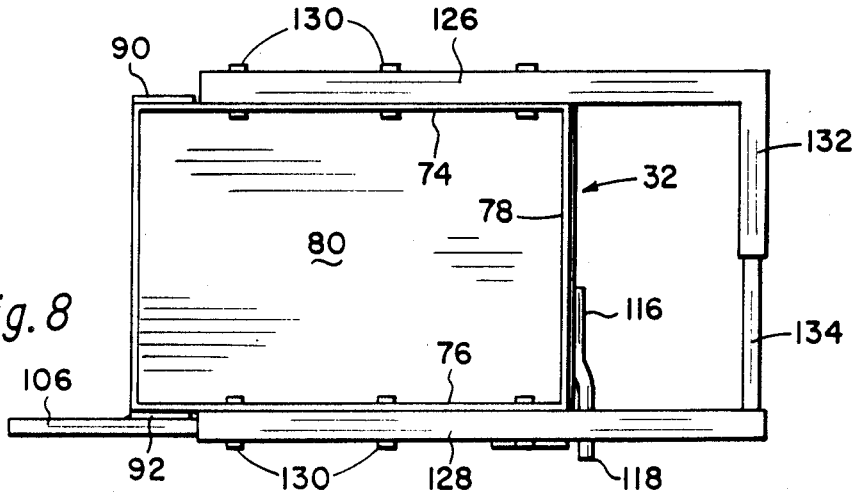
FIG. 8 is a plan view showing one form of the cart made in accordance with the present invention.
Figure 9:
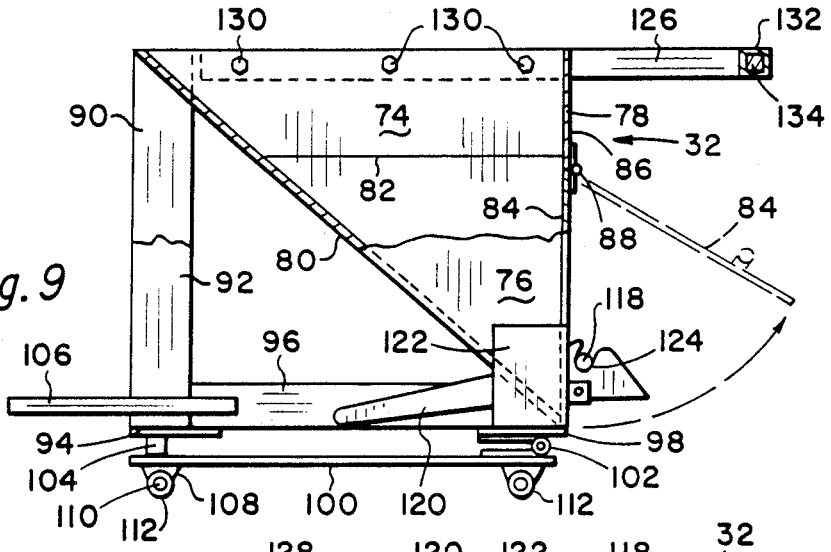
FIG. 9 is an elevation (partly in section) of the front of FIG. 8.
Figure 10:
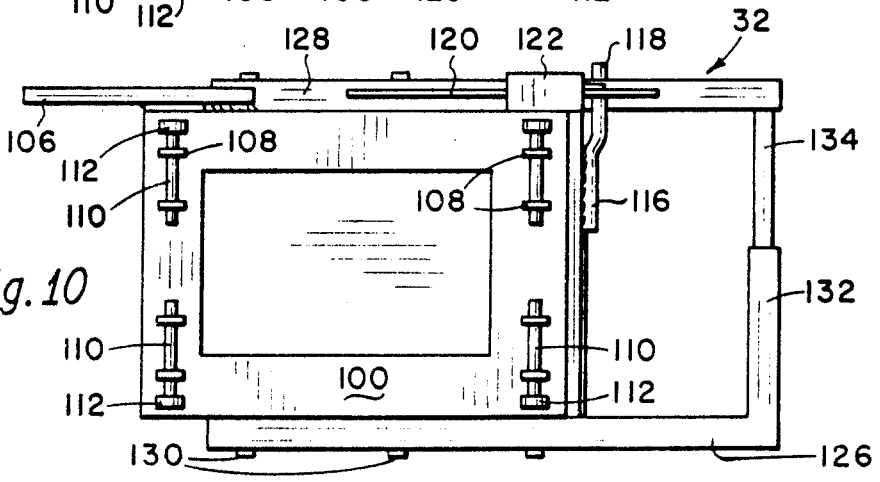
FIG. 10 is a bottom view of the cart shown in FIG. 8.

Turning now to a consideration of FIGS. 8, 9, and 10, the moveable cart 32 is shown therein. The cart consists of a pair of vertical triangular plates 74 and 76, a forward vertical plate 78 which connects along its vertical side edges with the forward vertical side edges of the plates 74, and an inclined rectangular plate 80 which connects at its bottom edge with the bottom edge of the front vertical plate 78 and which connects along its inclined sides with the inclined side edges of the plates 74 and 76. The space defined by the inner surfaces of the sides 74, 76, 78 and 80 is exactly equal to one cubic foot. When the container defined above is filled with sand up to the top edges of the sides 74, 76, 78, and 80, there will be exactly one cubic foot of sand in the container. A line 82 can be drawn or indented into the sides of the container to show a level representing exactly one half cubic foot.

The front plate 78 actually includes a lower portion 84 which is pivotally connected to the upper portion 86 thereof by means of a hinge 88. The lower portion or door 84 can swing to the dotted line position shown in FIGS. 2 and 9 and to the solid line position shown in FIG. 5.

A pair of parallel vertical plates 90 and 92 extend downwardly from the upper corners of the side plates 74 and 76 to a horizontal plate 94. A pair of horizontally extending vertical plates 96 (only one of which is shown in FIG. 9) are welded to the lower ends of the plates 90 and 92 and to the lower forward corners of the plates 74 and 76. A front horizontal support 98 is welded to the forward lower edge of the plates 96 adjacent to lower forward edge of the above described container. The above described structure rests on a flat support 100. The forward end of the container structure is pivotally connected to the support 100 by means of a hinge 102, part of which is welded to the bottom of the plate 98 and part of which is welded to the upper forward edge of the support 100. The rear of the plate 94 is provided with a pair of legs 104 (only one of which is shown in FIG. 9). A handle 106 is welded to the lower end of the vertical plate 92 such that the container structure can be pivoted relative to the support 100 around the hinge 102, in which case the legs 104 will be lifted away from the rear surface of the support 100. As best shown in FIG. 10, the support 100 is provided with a plurality of tabs 108 which extend downwardly from the lower surface of the support. Each pair of tabs 108 supports a shaft 110. A roller or wheel 112 is rotatably mounted at the end of each shaft 110.

Figure 4:
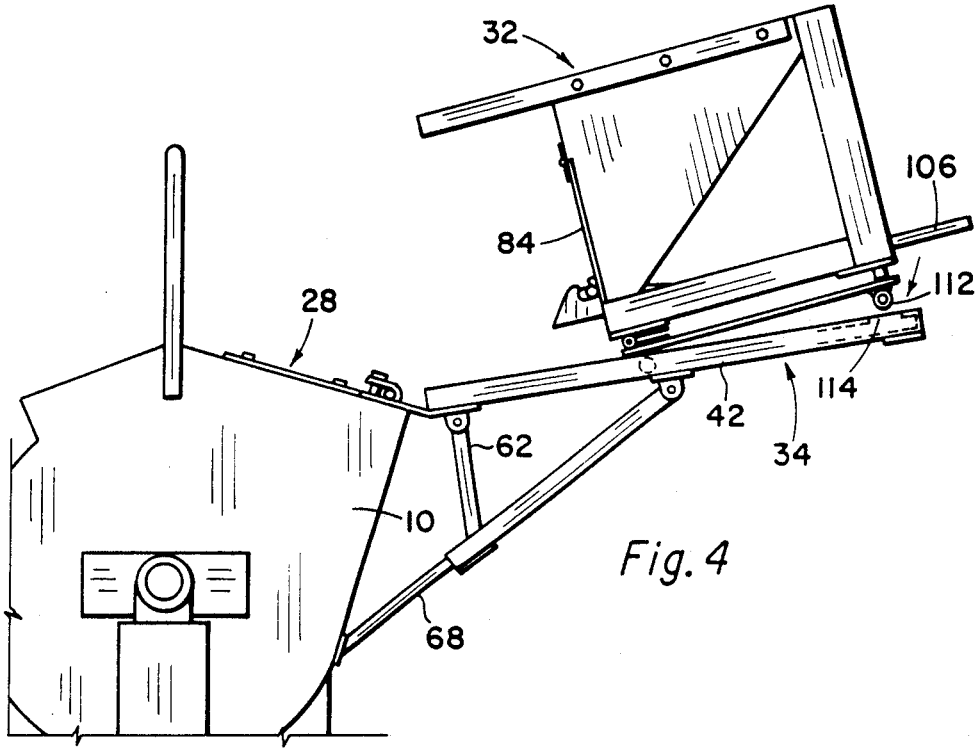
FIG. 4 is a partial front elevation showing the cart being inserted into its supporting track.

Turning now to a consideration of FIG. 6, each channel 42 is provided with a slot or opening 114 adjacent the left hand ends thereof. The cart shown in FIGS. 8 through 10 can be placed on the track by first inserting the forward wheels 112 into the channel 42 through the slots 114, then rolling the cart towards the mixer until the rear wheels 112 are over the slots 114 as shown in FIG. 4. The rear wheels are lowered into the channel 42 and the cart can then proceed in its intended fashion to move to and fro in the channels 42.

The lower end of the door is provided with a rod 116 which is welded thereto. An outer end 118 of the rod 116 is bent outwardly from the welded portion and extended parallel to the front of the door. A pivotal latch or lever 120 is pivotally connected to a box 122 which is attached to the lower corner of the plate 76. The latch has a slot 124 therein which engages the end 118 of the rod 116. When the cart is in its position shown in FIG. 2, the lever 120 is lifted so as to disengage the rod end 118 from the slot 124 at which time the door 84 can be opened as shown. The handle 106 is then lifted so that the cart can dump (the remaining) sand into the container as shown in FIG. 5.

The top of the container or cart is provided with a railing along three sides thereof. This railing consists of two L-shaped members 126 and 128 which are bolted to the sides 74 and 76 by means of bolts 130. The L-shaped member 126 has a hollow leg 132 which is adapted to telescopically receive leg 134 of L-shaped member 128. The forward end of this railing structure (the arms 132 and 134) will act as a stop against the top of the mixer 10 when rotating from the FIG. 2 position to the FIG. 5 position and beyond.

Figure 11:
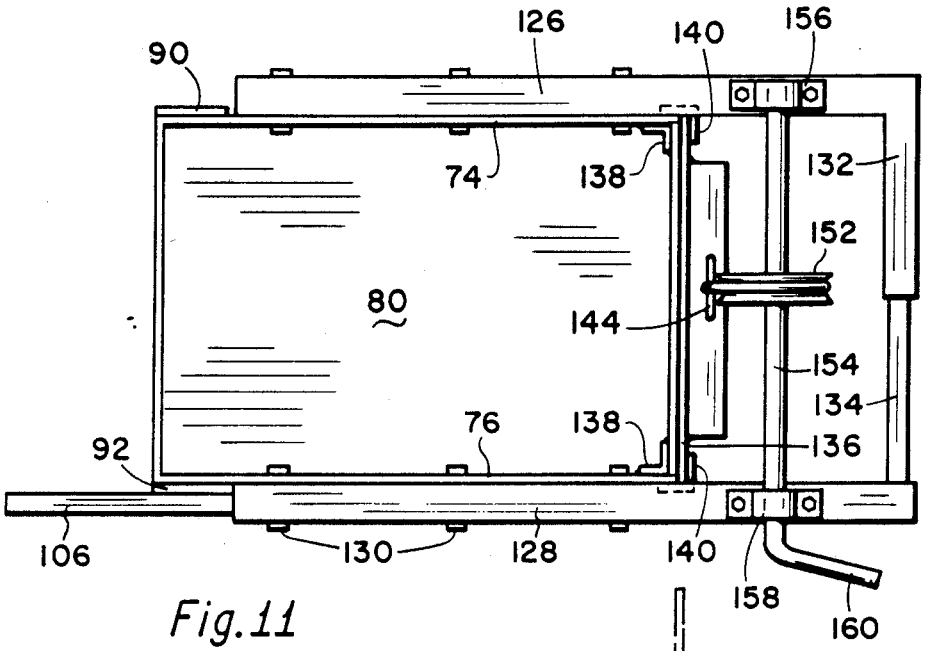
FIG. 11 is a view similar to FIG. 8, and on a slightly larger scale of a modified form of the cart.
Figure 12:
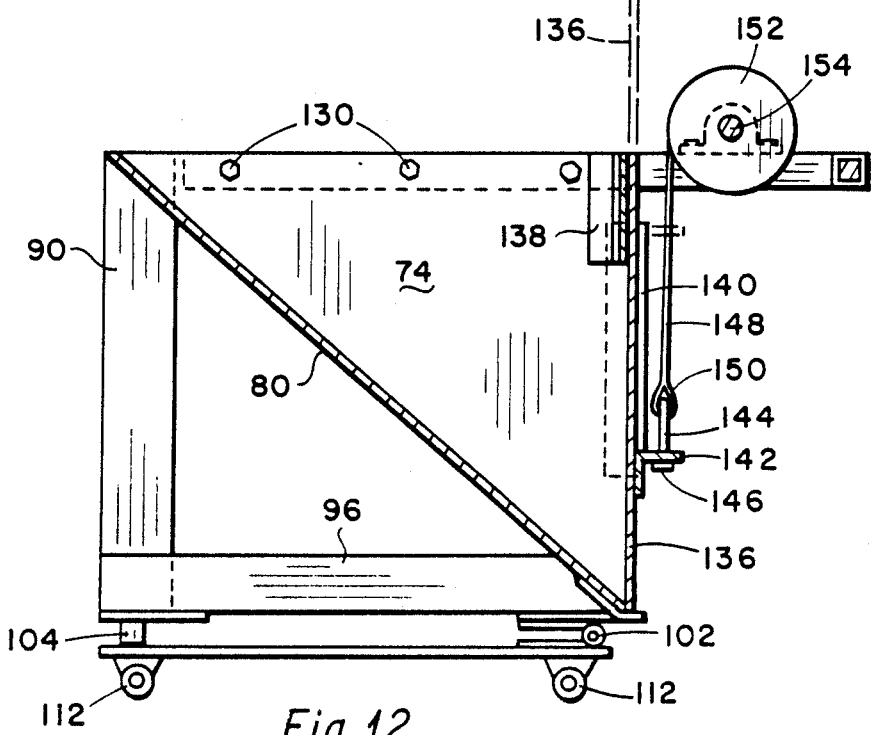
FIG. 12 is a sectional view taken along line 12—12 of FIG. 11.

FIGS. 11 and 12 show a modified form of the cart where the forward wall 78 (in FIGS. 8 and 9) has been replaced by a slidable front wall 136. A pair of short angle members 138 are welded to the upper forward corners at the insides of the plates 74 and 76. A pair of slightly longer angle members 140 are welded along the forward vertical side edges at the exterior of the plates 74 and 76. The plate 136 is thus received in the spaces between the angle members 138 and 140. A horizontal angle member 142 is welded to the forward surface of the plate 136 adjacent the bottom thereof. A U bolt 144 is positioned so that the lower ends project through a slot 146 in the angle 142. The lower ends of the U bolt are provided with nuts 146. A cable 148 having a loop 150 is positioned such that the loop 150 is received within the U of the U bolt 144. The upper end of the cable 148 is wound around a pulley 152 which is mounted on a shaft 154. The ends of the shaft 154 are supported in journals 156 and 158 which are bolted to the L-shaped members 126 and 128, respectively. The outer end of the shaft 154 is provided with a handle 160. Turning the handle 160 will raise the door 136 to the position shown in dotted lines in FIG. 12.

What is claimed is:

1. A method of adding a predetermined volume of particulate material to a reactor which comprises mounting an inclined track on the reactor such that a lower end of the track terminates adjacent an opening in the reactor, mounting a slideable container on the track for sliding movement from an upper end of the track to the lower end of the track, the container having an internal volume equal to said predetermined volume, and having a forward wall which can be opened to discharge the contents of the container, filling the container with particulate material when the container is adjacent the upper end of the track, allowing the container to side downwardly along the track until the container is adjacent the opening in the reactor, opening the forward wall of the container to allow particulate material to flow into the opening of the reactor and thereafter tilting the container towards the reactor to discharge any remaining particulate material in the container into the reactor.

2. A method according to claim 1 wherein the reactor is a mortar mixer and the particulate material is sand.

3. In combination with a mortar mixer of the type having an outer housing with an upper opening therein, and means mounted within the housing for mixing together sand, water, and cement; apparatus for adding a predetermined volume of sand to the mixer comprising an inclined track having a lower end and an upper end, the lower end of the track being attached to the mixer housing adjacent the opening, support means extending from the mixer housing to a location intermediate the ends of the track for supporting the track in its inclined position, a platform slideably mounted on the track for movement from the upper end thereof to the lower end thereof, a container mounted on the track for movement therewith, the container having a forward wall located adjacent the mixer housing when the container and platform are positioned at the lower end of the track, the container having additional side walls connected to the forward wall so as to form a space of said predetermined volume, said forward wall having a door therein which can be opened to discharge sand held in said space, said platform and said container being moveable together from a position adjacent the upper end of said track where the container is filled with said predetermined volume of sand towards and adjacent the mixer housing, means for opening said door when said container is positioned adjacent said lower end of said track for discharging sand from the container into the opening, means for tilting said container relative to said platform to discharge any remaining contents from said container into said mixer.

4. The improvement according to claim 3 wherein said track is releasably attached to said mixer housing.

5. The improvement according to claim 3 wherein said door is connected to the forward wall along a horizontal hinge disposed at the upper end of the door and wherein the means for opening the door comprises a pin mounted adjacent the lower end of the door and a latch which normally engages the pin such that moving the latch will release the pin and allow the door to swing open.

6. The improvement according to claim 3 wherein the forward wall of the container is provided with a vertically slidable door and wherein the means for opening the door comprises a rotatable pulley mounted adjacent the upper end of the container, a cable having one end wound around the pulley and another end connected to the door adjacent the vertical center thereof and a handle means for rotating the pulley, whereby rotating the pulley by means of the handle will cause the cable to lift the door to discharge sand from the container space into the opening.

7. The improvement according to claim 3 wherein the additional side walls comprise a pair of parallel triangular side walls connected across a pair of vertical side edges to the vertical side edges of the forward wall, the triangular side walls each having an upper horizontal edge and an inclined edge extending downwardly from the rear end of the horizontal edge to the lower end of the vertical side edge and an inclined wall connected to the inclined side edges of the triangular walls and the lower edge of the forward wall.

8. The improvement according to claim 3 wherein the platform is mounted on rollers received in channels on the track.

* * * * *